US010274269B1

(12) United States Patent
Nitta

(10) Patent No.: US 10,274,269 B1
(45) Date of Patent: Apr. 30, 2019

(54) ENHANCED MEDIUM DIRECTING MEMBER FOR USE IN A TUBE AND CHAMBER TYPE HEAT EXCHANGER

(71) Applicant: Takeyoshi Nitta, Upland, CA (US)

(72) Inventor: Takeyoshi Nitta, Upland, CA (US)

(73) Assignee: MIKUTAY CORPORATION, Ontario, CA (US)

( * ) Notice: Subject to any disclaimer, the term of this patent is extended or adjusted under 35 U.S.C. 154(b) by 0 days.

(21) Appl. No.: 15/947,311

(22) Filed: Apr. 6, 2018

(51) Int. Cl.

| | |
|---|---|
| ***F28F 1/10*** | (2006.01) |
| ***F28F 13/08*** | (2006.01) |
| ***F28F 13/12*** | (2006.01) |
| ***F28F 9/22*** | (2006.01) |
| ***F28F 1/00*** | (2006.01) |

(52) U.S. Cl.
CPC ..... *F28F 13/08* (2013.01); *F28F 1/006* (2013.01); *F28F 1/10* (2013.01); *F28F 9/22* (2013.01); *F28F 13/12* (2013.01); *F28F 13/125* (2013.01); *F28F 2009/228* (2013.01); *F28F 2250/102* (2013.01)

(58) Field of Classification Search
CPC .... F28F 1/006; F28F 1/40; F28F 13/08; F28F 13/12; F28F 13/125; F28F 2009/228; F28F 2250/102; F28F 2250/108
See application file for complete search history.

(56) References Cited

U.S. PATENT DOCUMENTS

| | | | | |
|---|---|---|---|---|
| 7,987,900 | B2 * | 8/2011 | Nitta | F28F 13/08 165/109.1 |
| 8,307,886 | B2 * | 11/2012 | Nitta | F28F 13/08 165/109.1 |
| 8,393,385 | B2 * | 3/2013 | Nitta | F28F 13/08 165/177 |
| 9,151,547 | B2 * | 10/2015 | Nitta | F28F 13/08 |
| 2014/0131022 | A1 * | 5/2014 | Nitta | F28F 13/12 165/177 |

* cited by examiner

*Primary Examiner* — Leonard R Leo

(57) ABSTRACT

A heat exchanger having an inlet tube, a chamber section, an outlet tube, and a medium directing member disposed within the chamber section. The medium directing member is provided with a first angled face, a second angled face, a first lateral wall, and a second lateral wall to obtain a desired heat exchange medium flow pattern within the chamber section, which generally comprise of two semi-circular symmetrical flow patterns, along with other flow alterations within the chamber section that facilitate improved heat transfer effectiveness. The medium directing member is provided with a first extension member and a second extension member as a means to couple the medium directing member within the chamber section, to obtain desired heat transfer between the chamber section and the medium directing member, as well as to allow a desired heat exchange medium flow pattern to transpire within the chamber section.

11 Claims, 6 Drawing Sheets

ENHANCED MEDIUM DIRECTING MEMBER FOR USE IN A TUBE AND CHAMBER TYPE HEAT EXCHANGER

BACKGROUND OF THE INVENTION

A typical heat exchanger comprises of a generally straight tubular section having a generally smooth exterior surface with a secondary extended surface comprising generally of fin structures coupled to the exterior surface of the tubular section. The tubular section may be round or rectangular in shape. The fin structure may be smooth, or may feature surface enhancements, such as louvers or dimples, for example. The typical heat exchanger design, generally called compact heat exchangers, pack as much surface area in a given package space, without necessarily being concerned with extracting as much performance out of a given surface area. Due to this design methodology, performance yield out of any given surface area is limited. However, the design compensates for low performance over a given surface area by packaging as much surface area in a given space. For example, wherein the primary surface area with the highest heat transfer performance, comprising of a generally tubular structure transporting heat exchange medium within may be limited, far more significant amount of secondary surface area is obtained by attaching extended surfaces on the primary surface. The extended secondary surfaces typically used in the art is usually in the form of fins. This design significantly increases the amount of surface area available to facilitate heat transfer, in a magnitude of a few times over the primary surface area, such as 2 times or more, for example. In such an arrangement, the primary surface area generally performs at the highest rate of heat transfer efficiency, while the extended surface area performs at a diminished capacity. Therefore, when considered as a package, the heat exchanger of such a design suffers from rather modest heat transfer performance, indicated by a low overall heat transfer coefficient, for example. Also, with the addition of fin structures, the heat exchanger may have to be made physically larger as a package or weigh more due to the addition of significant amount of fin material. Additionally, the parts count may significantly increase, while complicating the manufacturing procedure, due to the addition of fin structures, thus by extension, generally making the manufacturing process costly and complicated. Fin structures generally need to be fabricated out of an extremely thin material to function at an optimal performance level, making the structure prone to damage. Furthermore, applying significant amount of fin material to increase the heat transfer surface may in turn negatively impact the flow of heat transfer medium through such an arrangement, increasing the pressure drop of the heat exchange medium, further hampering the overall performance of the heat exchanger.

A tube and chamber heat exchanger with a medium directing insert takes a different approach to improving the heat transfer performance, by extracting as much performance out of any given surface area, while eliminating as much surface area of a heat exchanger that would not extract high level of heat transfer. Secondary surfaces in the form of fins are generally eliminated, while primary surface area extracting the highest level of heat transfer is maximized. Additionally, the heat transfer performance of a primary surface of the tube and chamber heat exchanger is enhanced by utilizing a heat exchange medium transporting technique that induces swirling and mixing effect to the heat transfer medium flowing within the heat exchanger, known in the art to enhance heat transfer efficiency, further enhancing the overall heat transfer performance. As a result, a heat exchanger of this kind performs at a very high efficiency level, indicated by a higher overall heat transfer coefficient throughout its surface area, lending to a smaller heat exchanger package, compared to a conventional heat exchanger design known in the art. A smaller heat exchanger package lends itself to further benefits, such as lighter weight, less material usage, and low cost. Reduced parts count as a result lends itself to an easier manufacturing process. A typical tube and chamber heat exchanger is characterized by having a distinct tube section, a chamber section, and a medium directing insert disposed within the chamber section.

The present invention is an improved tube and chamber heat exchanger utilizing an enhanced medium directing insert design yielding higher heat transfer performance, while simplifying the manufacturing process. Furthermore, the present invention features improvements to the medium flow pattern within the chamber section, which lends itself to reduction of pressure drop of heat exchange medium flowing inside the chamber section, an advantageous feature in a typical heat exchanger application. The present invention accomplishes all the benefits mentioned herein while retaining all the heat transfer characteristics of a tube and chamber heat exchanger, while simplifying the manufacturing process of assembling a heat exchanger comprising of the present invention.

SUMMARY OF THE INVENTION

A heat exchanger illustratively comprises an inlet tube, a chamber section, an outlet tube, and a medium directing member disposed within the chamber section. In the present invention, a heat exchange medium is introduced through the inlet tube, permitting flow of the heat exchange medium into the heat exchanger. As the inlet tube terminates, the heat exchange medium flowing within the inlet tube is introduced to the chamber section of the heat exchanger. The heat exchange medium exiting the inlet tube is directed towards a first angled face of the medium directing member, disposed within the chamber section. As the heat exchange medium is directed towards the first angled face of the medium directing member, the action creates a swirling and mixing effect to the heat exchange medium, which is known in the art to greatly enhance heat transfer efficiency.

The first angled face of the medium directing member has an inclined face, which permits contact of the heat exchange medium as it exits the inlet tube, while inducing great amount of swirling and mixing effect to the heat exchange medium within the chamber section. The inclined face of the medium directing member also functions to divert the flow of the heat exchange medium in a generally vertical direction, generally following the slope of the first angled face of the medium directing member. Ample surface area is provided on the first angled face of the medium directing member to obstruct direct flow of the heat exchange medium from the inlet tube attached on the anterior side of the chamber section to the outlet tube attached on the posterior side of the chamber section. The first angled face of the medium directing member is generally free of any heat exchange medium flow restricting obstructions on its lateral edges that may hamper the amount of swirling and mixing effect occurring to the heat exchange medium within the chamber section. Minimizing presence of obstruction on the first angled face further lends itself to reduce potential pressure drop effect to the flow of heat exchange medium, which may be detrimental to the heat transfer performance.

The chamber section is hollow, permitting flow of the heat exchange medium within. The chamber section frontal and rearward sections are established by a chamber anterior wall and a chamber posterior wall, spaced apart, leaving a space between the respective walls. The chamber anterior wall and the chamber posterior wall may be joined concentrically together by a chamber lateral wall, completing the chamber section. The diameter of the chamber section is generally greater than the diameter of the inlet tube and the outlet tube. As the heat exchange medium is directed into the interior of the chamber section, the heat exchange medium is further directed towards one end of the chamber section by the medium directing member. Once the heat exchange medium reaches the one end of the chamber section, the flow of the heat exchange medium is diverted into two divergent flow patterns, generally symmetrical to one another, in a semi-circular manner within the chamber section. The two semi-circular flow patterns generally flow away from each other, while generally vertically axially aligned to one another, following the contour of the interior of the chamber section. The configuration of the interior contour of the chamber section directs and channels the flow of the heat exchange medium within the chamber assembly. The medium directing member has a second angled face generally on the opposite side of the first angled face, laterally abutted by a first lateral wall and a second lateral wall, preventing heat exchange medium introduced into the chamber section from the tube inlet to directly flow to the tube outlet, without first going through either a first lateral passthrough or a second lateral passthrough provided by the medium directing member.

As the two semi-circular heat exchange medium flow paths complete their respective flow, following along the interior contour of the chamber section, first half of the heat exchange medium is directed to the first lateral passthrough, while the other half is directed to the second lateral passthrough. The first lateral passthrough and the second lateral passthrough are a feature facilitated by the medium directing member and the chamber lateral wall. The first lateral passthrough and the second lateral passthrough are positioned generally on the opposing lateral sides of the medium directing member. Therefore, as the two semi-circular flows are introduced into their respective lateral passthroughs, the two semi-circular flows are directed to collide into each other, mixing and agitating the flow of heat exchange medium as a result, known in the art to improve heat transfer effectiveness by breaking the boundary layer that forms on the heat exchange medium. Once the two semi-circular heat exchange medium flow through their respective lateral passthroughs, the two semi-circular flow paths converge to form one single flow once again. The point at which the two semi-circular flow paths converge fully is generally on the surface comprising the second angled face of the medium directing member, which is positioned opposite of the first angled face of the medium directing member.

As the two semi-circular flows converge into one, the heat exchange medium flow direction is simultaneously directed in a new longitudinal flow direction by the medium directing member, wherein the angle of an attack of the new flow direction is substantially divergent from the respective lines of flow of each semi-circular flow paths. The second angled face of the medium directing member has an inclined surface, generally diverting the flow of the heat exchange medium to nearly a perpendicular flow pattern in relation to the two semi-circular flow paths, axially aligned to the longitudinal axis of the outlet tube. The second angled face of the medium directing member is at least partially laterally bound by the first lateral wall and the second lateral wall, restricting flow of the heat exchange medium from the posterior side of the chamber section to the anterior side of the chamber section. The chamber section is provided with the outlet tube, permitting discharge of the heat exchange medium out of the heat exchanger.

The heat exchanger may comprise the inlet tube, the chamber section, the outlet tube, and the medium directing member disposed within the chamber section. In other embodiment of the present invention, a plurality of heat exchangers as described herein may be coupled together in a serial or a parallel fashion to form a larger heat exchanger assembly. As such, the flow pattern described herein may be repeated several times dependent upon the number of inlet tubes, chamber sections, outlet tubes, and medium directing members packaged within a particular embodiment of a heat exchanger assembly.

As the heat exchange medium flows inside the flow path established by respective heat exchanger components described herein, the heat exchange medium encounters a plurality of obstacles that force fluid flow directional changes that disrupt heat transfer boundary layers, which in turn improves heat transfer effectiveness of the heat transfer medium. The present invention accomplishes the improved heat transfer efficiency, while also minimizing the potential for pressure drop effect to the flow of heat exchange medium by having a favorable heat exchange medium flow path established by the medium directing member. In a preferred embodiment of the present invention, the flow pattern is accomplished without addition of secondary surface features in the heat exchange medium pathway, such as an offset fin or other structures known in the art, which may complicate manufacturing steps.

In a prior art heat exchanger, heat contained in a first heat transfer medium flowing inside a tube section transfers heat first by convection from the first heat transfer medium to the material comprising the tube section. Once heat enters the material comprising the tube section, heat travels by conduction through the material comprising the tube section to the exterior surface of the tube section. The tube section exterior surface area is generally classified as a primary surface area. As heat reaches the external surface of the primary surface area, heat may be generally directly transferred to a second heat transfer medium surrounding the tube section by convection. With the prior art heat exchanger design, however, once heat reaches the outside primary surface of the tube section, far more heat is transferred to a secondary surface feature in a form of fin structures. The fin structures are generally considered as secondary surface area, as heat from the primary surface is transferred to the secondary surface area instead of transferring heat directly from the primary surface area to the second heat transfer medium. As a result, prior to transferring heat to the second heat transfer medium, a second heat transfer conduction step is added, wherein heat from the primary surface is transferred by conduction to the secondary surface area. Therefore, an additional heat transfer step is added, prior to releasing heat contained within the first heat transfer medium to the second heat transfer medium.

In the present invention, in comparison, heat transfer from the first heat transfer medium to the second heat transfer medium is primarily through the primary surface area. Heat contained within the first heat exchange medium flowing in the tube section, generally transfers heat to the second heat transfer medium without transferring heat to a secondary surface feature. Similarly, heat contained within the first heat exchange medium flowing in the chamber assembly section, generally transfers heat to the second heat transfer medium without transferring heat to a secondary surface feature. By eliminating an additional heat conduction step from the primary surface to the secondary surface area, heat transfer efficiency is greatly improved. Furthermore, by providing means to greatly increase the primary surface area in a given package space compared to the prior art heat exchanger design, heat transfer efficiency is greatly enhanced. Generally, in the present invention, in any given package space, twice as much primary surface area may be packaged, compared to the prior art heat exchangers generally classified as compact heat exchangers, by eliminating the need to allocate space for secondary surface area. In some other embodiment of the present invention, more than twice the primary surface area can be packaged, compared to the prior art heat exchangers generally classified as compact heat exchangers, greatly enhancing the heat exchanging performance.

In the present invention, compared to the prior art tube and disk type heat exchangers, the medium directing member is designed with the first angled face which maximizes the heat exchange medium agitating and mixing effect potential within the chamber section, by having a generally planar surface free of any obstruction on its lateral sides, permitting free disbursement of heat exchange medium on the surface of the first angled face feature of the medium directing member. Such feature allows for improved heat transfer efficiency, while reducing pressure drop effect to the heat exchange medium. Furthermore, the medium directing member features the first lateral wall and the second lateral wall feature on the second angled face of the medium directing member. The feature enhances means to coordinate flow of the heat exchange medium in desired ways, improving the heat transfer performance without significantly increasing pressure drop effect to the heat exchange medium flow, providing superior heat transfer effectiveness compared to prior art medium directing insert designs known in the art.

In the present invention, compared to the prior art tube and chamber heat exchangers, the medium directing member features a first extension member and a second extension member as an extension to the medium directing member. The first extension member and the second extension member feature outer facing surface, respectively, conforming in shape to permit the features to engagingly couple to the interior surface of the chamber section. The addition of the first extension member and the second extension member enhances the performance of the heat exchanger by providing enhanced surface contact between the chamber section and the medium directing member, effectively transferring heat to the medium directing member from the chamber section, or vice versa, dependent on the direction of the heat transfer, vastly improving the performance of the overall heat exchanger. The first extension member and the second extension member closely conform to the contour of the interior of the chamber section, whereby pressure drop effect to the flow of heat exchange medium flowing within the chamber section is drastically reduced, improving the overall performance of the heat exchanger.

The tube and chamber sections of the flow path as well as the medium directing member may feature surface enhancements, such as, but not limited to, dimples, fins, louvers, that is known in the art to enhance heat transfer effectiveness in a heat exchanger application.

The tube and chamber sections as well as the medium directing member of the heat exchanger may be manufactured by stamping, cold forging, machining, or by other manufacturing methods known in the art. The tube and chamber sections of the heat exchanger may be manufactured as one piece or may be manufactured as separate pieces. The medium directing member of the heat exchanger may comprise of one piece of material or may comprise as an assembly of two or more components. The heat exchanger may be coupled together by means of brazing, soldering, welding, mechanical means, or adhesive means known in the art.

Other features and advantages of the present invention will be readily appreciated, as the same becomes better understood after reading the subsequent description taken in conjunction with the accompanying drawings.

DETAILED DESCRIPTION

Figure 1:
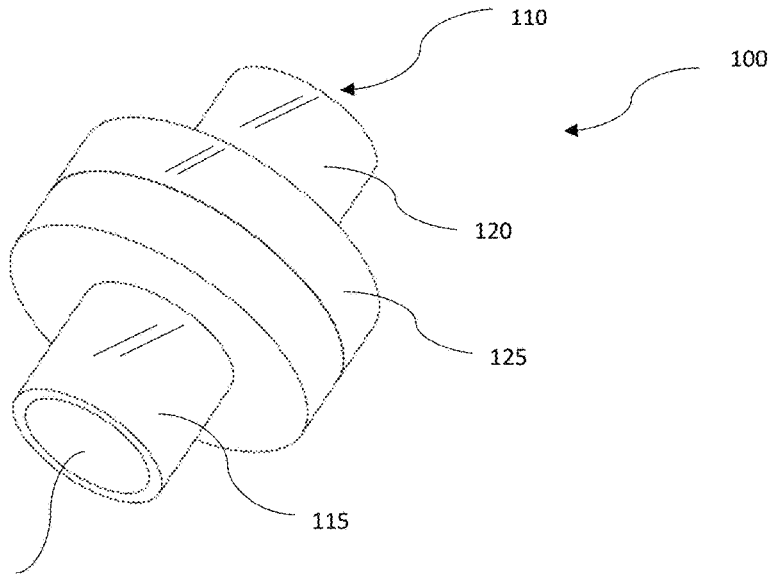
FIG. 1 is a perspective view of a heat exchanger according to an embodiment of the present invention.
Figure 2:
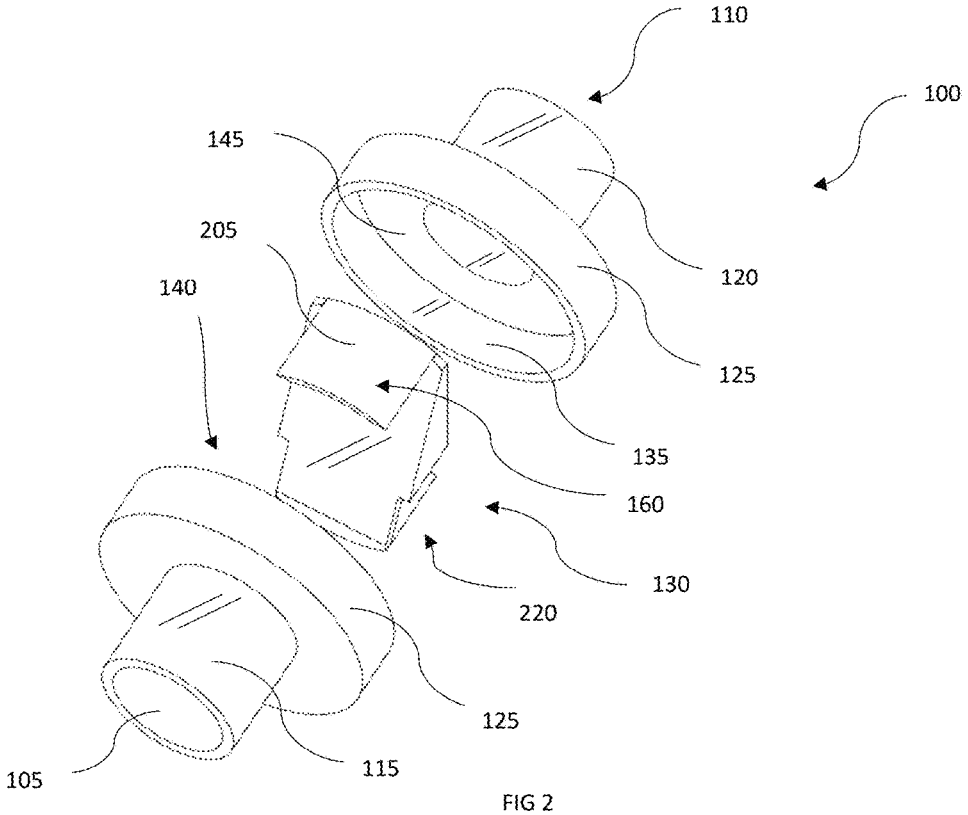
FIG. 2 is an exploded view of a heat exchanger illustrating a medium directing member disposed within an embodiment of the present invention.

Referring to the drawings and in particular FIG. 1 and FIG. 2, an embodiment of a heat exchanger 100 is shown. The heat exchanger 100 includes an inlet tube 115, a chamber section 125, and an outlet tube 120. The inlet tube 115 is coupled to the chamber section 125, having a disk inlet 105 to introduce a heat exchange medium into the heat exchanger 100. An embodiment of the inlet tube 115 is shown as cylindrical in shape. However, the inlet tube 115 may be of any other geometric shape like ovoid or rectangular parallelepiped, for example. The chamber section 125 may also be cylindrical in shape, or any other geometric shape like ovoid or rectangular parallelepiped, for example. The heat exchanger 100 is provided with the outlet tube 120 having a disk outlet 110 to discharge the heat exchange medium out of the heat exchanger 100. The outlet tube 120 is coupled to the chamber section 125. An embodiment of the outlet tube 120 may be cylindrical in shape, or it may be of any other geometric shape like ovoid or rectangular parallelepiped, for example. The chamber section 125 is hollow, fluidly connected to the disk inlet 105 and the disk outlet 110, to introduce the heat exchange medium into the heat exchanger 100 and then to discharge the heat exchange medium from the heat exchanger 100, respectively. Referring now to FIG. 2, disposed within the chamber section 125 is a medium directing member 130. The medium directing member 130 is positioned within the chamber section 125 to provide the heat exchanger 100 with means to alter the flow of heat exchange medium flowing within the heat exchanger 100 to a desired effect, providing favorable heat exchange characteristics. The heat exchanger 100 generally utilizes two heat exchange mediums. A first heat exchange medium flows within the heat exchanger 100. A second heat exchange medium flows outside of the heat exchanger 100. The heat exchange medium utilized within the heat exchanger 100 may be the same medium variant as the heat exchange medium utilized outside the heat exchanger 100. Alternatively, the heat exchange medium utilized within the heat exchanger 100 may differ from the heat exchange medium utilized outside the heat exchanger 100. The objective of the heat exchanger 100 is to transfer heat from the first heat exchange medium contained within the heat exchanger 100 to the second heat exchange medium flowing outside of the heat exchanger 100, or vice versa. For illustrative purposes, the heat exchanger 100 is shown with only one chamber section 125. However, a plurality of heat exchangers 100 may be combined in a serial or a parallel fashion, or a combination of serial and parallel connections to form a larger heat exchanger assembly. A plurality of heat exchangers 100 may be coupled either with an inlet tank or an inlet manifold to a plurality of free ends of inlet tubes 115. A plurality of heat exchangers 100 may be coupled either with an outlet tank or an outlet manifold to a plurality of free ends of outlet tubes 120. A plurality of heat exchangers 100 may also be combined end to end to create a larger heat exchanger assembly.

Figure 3:
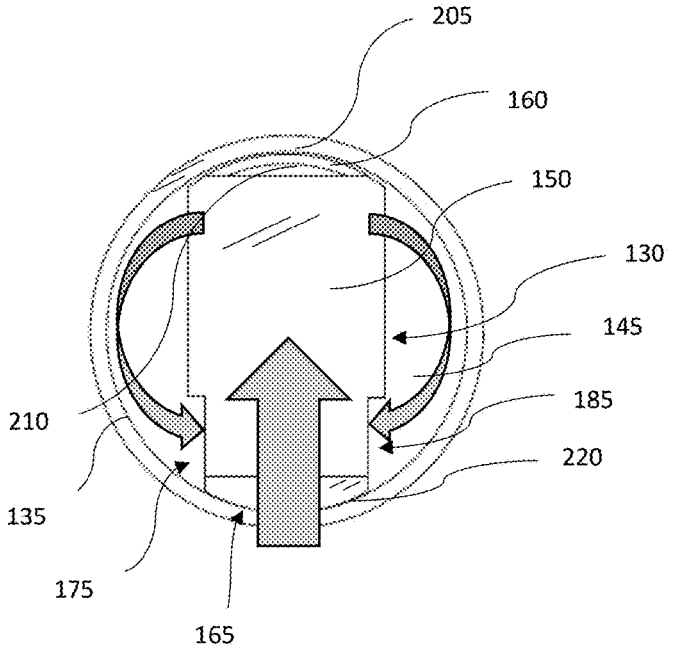
FIG. 3 is a schematic frontal view of a chamber section interior, illustrating the general heat exchange medium flow pattern within a heat exchanger according to an embodiment of the present invention.
Figure 4:
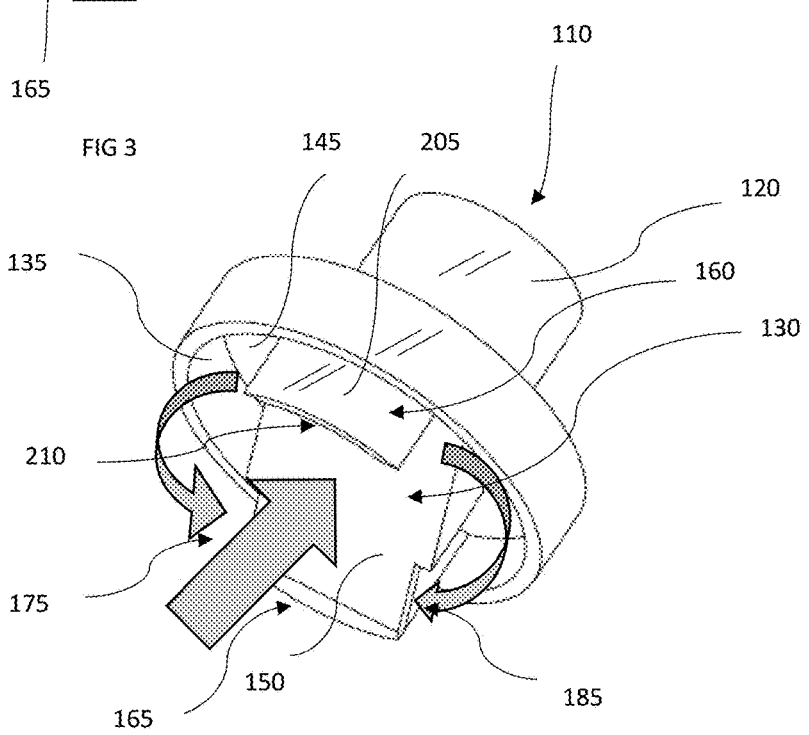
FIG. 4 is a schematic perspective view of a chamber section interior, illustrating the general heat exchange medium flow pattern within a heat exchanger according to an embodiment of the present invention.
Figure 5:
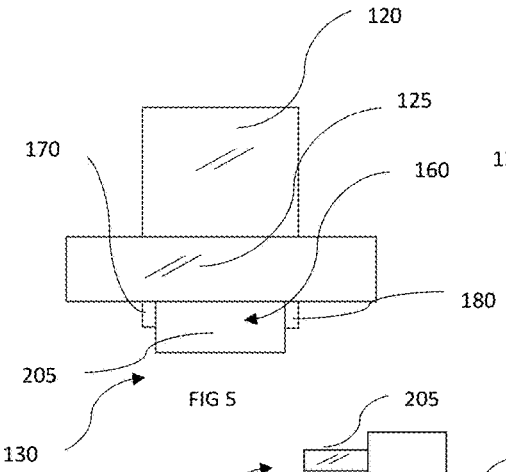
FIG. 5 is an internal top view of a heat exchanger according to an embodiment of the present invention, with an anterior portion of a chamber section removed, illustrating the positioning of a medium directing member within a posterior portion of the chamber section interior.

Now referring to drawings FIG. 3 and FIG. 4, a schematic heat exchange medium flow characteristics within the heat exchanger 100 is shown. The heat exchange medium introduced into the chamber section 125 from the disk inlet 105 initially flows in a first longitudinal axial direction, generally parallel to the longitudinal axial characteristics of the inlet tube 115. As the heat exchange medium travels further into the chamber section 125 interior, the heat exchange medium is directed towards the medium directing member 130, terminating the flow in the first longitudinal axial direction, resulting in an altered flow characteristic from the first longitudinal axial flow direction. As the heat exchange medium is directed from the disk inlet 105 in the first axial flow direction towards the medium directing member 130, the heat exchange medium is disbursed on the generally planar surface feature of a first angled face 150 of the medium directing member 130. The first angled face 150 is a generally planar, sloped surface feature having generally no lateral obstructions to the chamber section 125 interior. The first angled face 150 is positioned in such a manner that the generally planar surface comprising the first angled face 150 is positioned at an acute angle with respect to the longitudinal axis established by the inlet tube 115. When the heat exchange medium contacts the first angled face 150, the heat exchange medium is generally directed to flow vertically towards one lateral section of the chamber section 125. Once heat exchange medium is directed towards the one general lateral section of the chamber section 125, the heat exchange medium is further directed to a new flow direction following the contour of a chamber lateral wall 135. The heat exchange medium is directed to flow in a generally two semi-circular flow paths within the chamber section 125. The two semi-circular flow paths generally flow in a vertical fashion relative to the first longitudinal axial direction of the heat exchange medium flow. The semi-circular flow paths generally flow away from each other in a generally symmetrical fashion along the surface of the chamber lateral wall 135. The two semi-circular heat exchange medium flow paths within the chamber section 125 are laterally bound by the chamber lateral wall 135, while the frontal path of the heat exchange medium is bound by a chamber anterior wall 140. The rearward path is bound by a chamber posterior wall 145 of the chamber section 125. The two semi-circular heat exchange medium flows are restricted from flowing back towards the central axis of the chamber section 125 by the medium directing member 130, thereby forcing the two semi-circular heat exchange medium flow paths to closely follow the contour of the chamber lateral wall 135.

Figure 15:
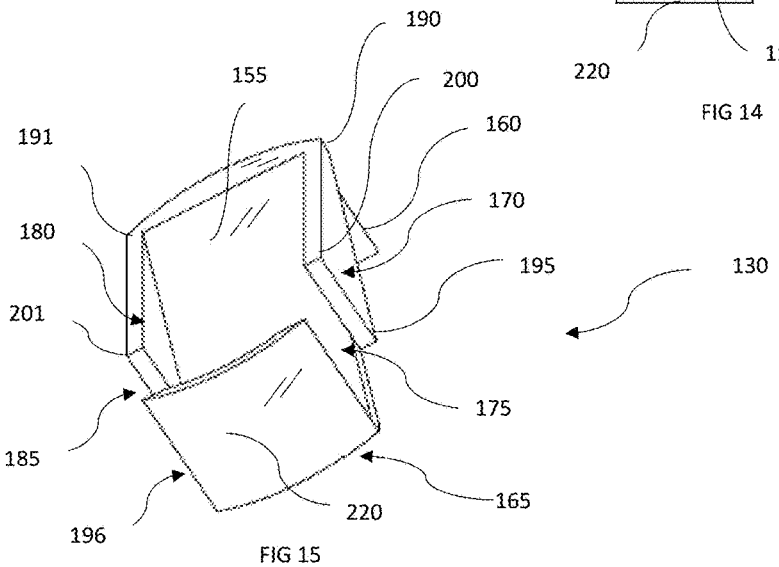
FIG. 15 is a perspective bottom posterior view of a medium directing member according to an embodiment of the present invention.

As the two semi-circular flows individually complete their respective flow within the chamber section 125, the first half of the semi-circular flow is directed towards a first lateral passthrough 175, while the other half of the heat exchange medium is directed to flow towards a second lateral passthrough 185. The first lateral passthrough 175 and the second lateral passthrough 185 are provided as a feature of the medium directing member 130. The first lateral passthrough 175 and the second lateral passthrough 185 are generally laterally aligned on a first lateral side and a second lateral side of the medium directing member 130, respectively. Therefore, as the heat exchange medium is directed through the first lateral passthrough 175 and the second lateral passthrough 185, the two semi-circular flows of the heat exchange medium are directed to collide in to each other. The first lateral passthrough 175 and the second lateral passthrough 185 facilitate means to align the two semi-circular heat exchange medium flows to collide into each other with greater precision and accuracy to the desired effect, causing effective mixing and agitating effect to the flow of the heat exchange medium, which is known in the art to improve heat transfer effectiveness by reducing boundary layer formation to the heat exchange medium. Referring now to FIG. 15, the heat exchange medium introduced from the first lateral passthrough 175 and the second lateral passthrough 185 are directed towards a second angled face 155. The second angled surface 155 features a generally planar surface, laterally partially bound by a first lateral wall 170 and a second lateral wall 180, forming the lateral barriers for the heat exchange medium flowing towards the second angled face 155. Once the heat exchange medium flows towards the second angled face 155, the flow of heat exchange medium towards the front of the chamber section 125 is restricted by the second angled face 155, the first lateral wall 170, and the second lateral wall 180. The rearward path of heat exchange medium is terminated by the chamber posterior wall 145. As the two semi-circular flows of heat exchange medium are directed toward the second angled face 155 of the medium directing member 130, the two semi-circular flows of heat exchange medium are combined to form a singular flow regime, guided by the second angled face 155, the first lateral wall 170, and the second lateral wall 180 of the medium directing member 130. Immediately following the combination of the heat exchange medium flow into a unitary flow regime, the heat exchange medium is then directed to flow into the outlet tube 120, in a new flow direction generally following the longitudinal axial characteristics of the outlet tube 120. Once the heat exchange medium completes its flow within the outlet tube 120, the heat exchange medium is discharged out of the heat exchanger 100 through the disk outlet 110.

To achieve effective heat transfer, means to disturb the normalized flow of the heat exchange medium with agitation, swirling, or mixing effect is known in the art to minimize formation of boundary layer that may be unfavorable to effective heat transfer. In an embodiment of the present invention, means for mixing and agitating effect is provided by combining flow establishing features of the inlet tube 115, the outlet tube 120, the chamber lateral wall 135, the chamber anterior wall 140, and the chamber posterior wall 145, combined with agitating and mixing feature of the first angled face 150, the second angled face 155, the first lateral passthrough 175, and the second lateral passthrough 185.

Referring now to FIGS. 5, 6, 7, and 8, positioning and locating means of the medium directing member 130 within the chamber section 125 in an embodiment of the present invention is shown. The medium directing member 130 is disposed within the chamber section 125, in a vessel established by the chamber lateral wall 135, the chamber anterior wall 140, and the chamber posterior wall 145. The first angled face 150 features a sloped planar surface positioned with a spatial separation from the chamber anterior wall 140. Ample spatial separation between the first angled face 150 and the chamber anterior wall 140 is provided to minimize pressure drop effect to the heat exchange medium flowing inside the chamber section 125. The first angled face 150 is generally longitudinally axially aligned with the disk inlet 105 from which the heat exchange medium will be directed to the first angled face 150. The first angled face 150 is positioned and provided with ample planar vertical and lateral surface within the chamber section 125, obstructing direct flow of the heat exchange medium from the disk inlet 105 to the disk outlet 110, maximizing disbursement effect to the heat exchange medium within the chamber section 125. A top surface first extension member 205 engagingly couples the chamber lateral wall 135, establishing the top vertical alignment of the medium directing member 130 within the chamber section 125. A bottom surface second extension member 220 engagingly couples the chamber lateral wall 135, establishing the bottom vertical alignment of the medium directing member 130 within the chamber section 125. The lateral positioning means of the medium directing member 130 within the chamber section 125 is also facilitated by the top surface first extension member 205 and the bottom surface second extension member 220.

Figure 7:
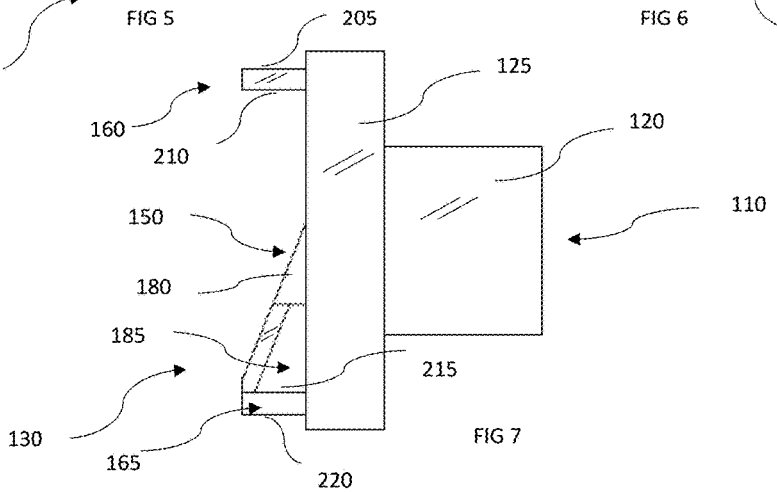
FIG. 7 is an internal side view of a heat exchanger according to an embodiment of the present invention, with an anterior portion of a chamber section removed, illustrating the positioning of a medium directing member within a posterior portion of the chamber section interior.
Figure 8:
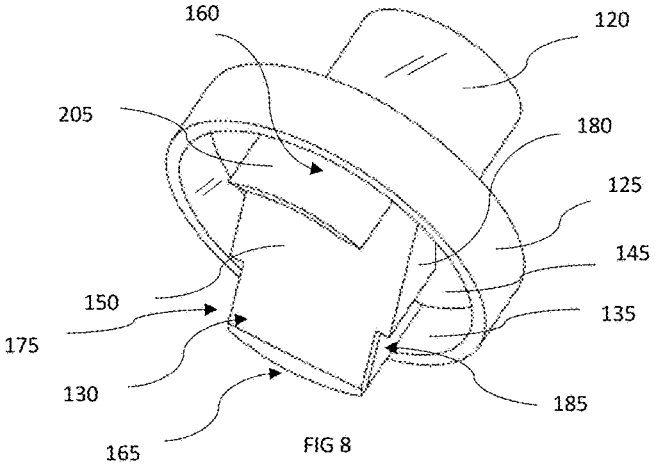
FIG. 8 is an internal perspective view of a heat exchanger according to an embodiment of the present invention, with an anterior portion of the chamber section removed, illustrating the positioning of a medium directing member within a posterior portion of the chamber section interior.
Figure 9:
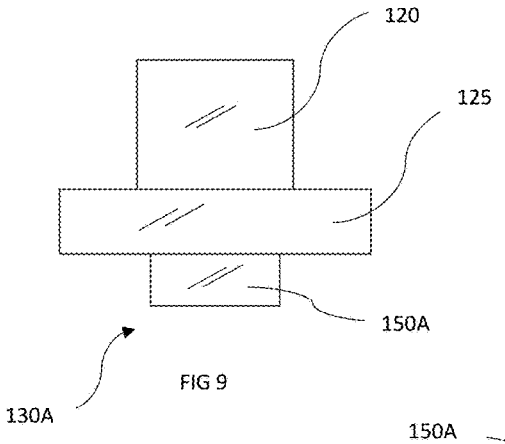
FIG. 9 is an internal top view of a heat exchanger according to another embodiment of the present invention, with an anterior portion of a chamber section removed, illustrating the positioning of a medium directing member within a posterior portion of the chamber section interior.
Figure 10:
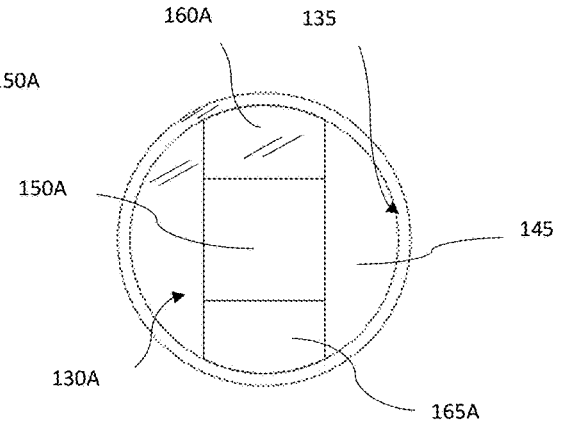
FIG. 10 is an internal frontal view of a heat exchanger according to another embodiment of the present invention, with an anterior portion of a chamber section removed, illustrating the positioning of a medium directing member within a posterior portion of the chamber section interior.
Figure 11:
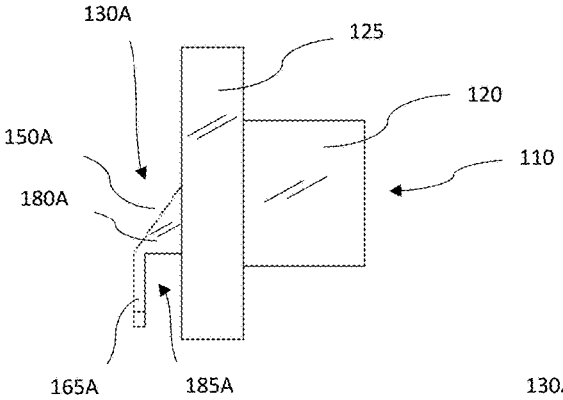
FIG. 11 is an internal side view of a heat exchanger according to another embodiment of the present invention, with an anterior portion of a chamber section removed, illustrating the positioning of a medium directing member within a posterior portion of the chamber section interior.
Figure 12:
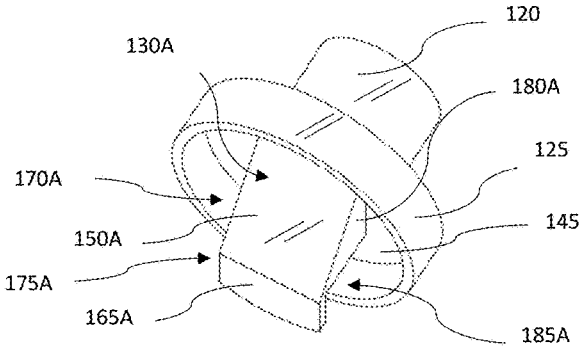
FIG. 12 is an internal perspective view of a heat exchanger according to another embodiment of the present invention, with an anterior portion of a chamber section removed, illustrating the positioning of a medium directing member within a posterior portion of the chamber section interior.

Referring now to FIG. 7 and FIG. 8, the medium directing member 130 is provided with a first extension member 160 and a second extension member 165, extending away from the top leading edge and the bottom leading edge of the medium directing member 130, respectively. The first extension member 160 extends from the top leading edge of the medium directing member 130. The first extension member 160 features an outer surface facing the chamber lateral wall 135, conforming to the shape of the chamber lateral wall 135, positioned at an acute angle in relation to the first angled face 150. The top surface first extension member 205 faces the chamber lateral wall 135, wherein the surface of the first extension member 160 facing the chamber lateral wall 135 is generally convex in shape, engagingly coupling the surface of the chamber lateral wall 135. The surface of the first extension member 160 facing the chamber lateral wall 135 may be mechanically coupled to the chamber lateral wall 135, or preferably be brazed, welded, or bonded together by adhesive means known in the art to act as an effective heat conducting surface, enhancing the performance of the heat exchanger 100. The lateral width of the first extension member 160 may be generally set at the width of the first angled face 150. However, the first extension member 160 may be wider or narrower than the width of the first angled face 150. The leading edge of the first extension member 160 may extend axially longitudinally in an anterior direction to contact the chamber anterior wall 140. In another embodiment of the present invention, the leading edge of the first extension member 160 may extend axially longitudinally towards the chamber anterior wall 140, though it may not contact the chamber anterior wall 140. The first extension member 160 and the first angled face 150 may be formed from a unitary piece of material. In another embodiment of the present invention, the first extension member 160 and the first angled face 150 may be fabricated from two separate pieces, coupled together by mechanical means, brazing, welding, bonding by adhesive means, or other coupling means known in the art. The top surface first extension member 205 engagingly couples the surface of the chamber lateral wall 135 of the chamber section 125, providing valuable heat conduction surface, effectively transferring heat to the medium directing member 130 from the chamber lateral wall 135, or vice versa, dependent on the direction of heat transfer, improving the overall heat transfer performance of the heat exchanger 100.

Referring again to FIG. 7 and FIG. 8, the medium directing member 130 is provided with the second extension member 165, extending from the bottom leading edge of the medium directing member 130. The second extension member 165 features an outer surface facing the chamber lateral wall 135, conforming to the shape of the chamber lateral wall 135, positioned at a reflex angle in relation to the first angled face 150. The bottom surface second extension member 220, the outwardly facing surface of the second extension member 165 facing the chamber lateral wall 135, is generally convex in shape, engagingly coupling the surface of the chamber lateral wall 135 of the chamber section 125, providing valuable heat conduction surface, effectively transferring heat to the medium directing member 130 from the chamber lateral wall 135, or vice versa, dependent on the direction of heat transfer, improving the overall heat transfer performance of the heat exchanger 100. The bottom surface second extension member 220 may be mechanically coupled to the chamber lateral wall 135, or preferably be brazed, welded, or bonded together by adhesive means known in the art to act as an effective heat conducting surface, enhancing the performance of the heat exchanger 100. The lateral width of the second extension member 165 may be generally set at the width of the first angled face 150. However, the second extension member 165 may be wider or narrower than the width of the first angled face 150. The leading edge of the second extension member 165 may extend axially longitudinally in a posterior direction to contact the chamber posterior wall 145. In another embodiment of the present invention, the leading edge of the second extension member 165 may extend axially longitudinally towards the chamber posterior wall 145, though it may not contact the chamber posterior wall 145. The second extension member 165 and the first angled face 150 may be formed from a unitary piece of material. In another embodiment of the present invention, the second extension member 165 and the first angled face 150 may be fabricated from two separate pieces, coupled together by mechanical means, brazing, welding, bonding by adhesive means, or other coupling means known in the art. The bottom surface second extension member 220 engagingly couples the surface of the chamber lateral wall 135 of the chamber section 125, providing valuable heat conduction surface, effectively transferring heat to the medium directing member 130 from the chamber lateral wall 135, or vice versa, dependent on the direction of heat transfer, improving the overall heat transfer performance of the heat exchanger 100.

Figure 6:
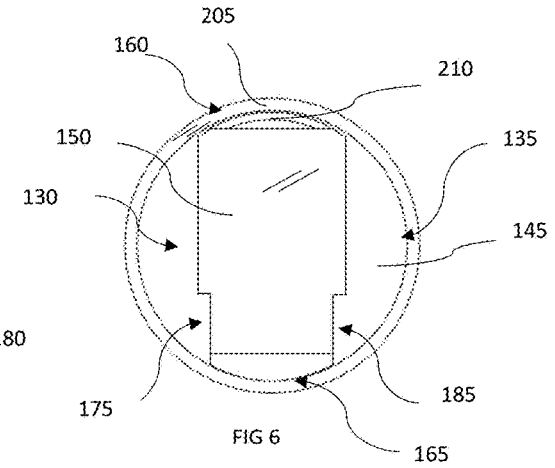
FIG. 6 is an internal frontal view of a heat exchanger according to an embodiment of the present invention, with an anterior portion of the chamber section removed, illustrating the positioning of a medium directing member within a posterior portion of the chamber section interior.

Now referring to FIG. 6, FIG. 7, and FIG. 8, the medium directing member 130 features the first extension member 160 and the second extension 165, engagingly coupling the medium directing member 130 to the chamber section 125, providing valuable heat conducting surface to the medium directing member 130 while also providing locating means for the medium directing member 130 within the chamber section 125. Without the locating means provided by the first extension member 160 and the second extension member 165, the medium directing member 130 may be positioned incorrectly within the chamber section 125 during assembly, diminishing the performance of the heat exchanger 100 once assembly is completed, or resulting in a completely non-functional heat exchanger. The first extension member 160 has a bottom surface first extension member 210 facing towards the first angled surface 150. The bottom surface first extension member 210 closely follows the contour of the chamber lateral wall 135, providing maximum agitation and mixing effect to the heat exchange medium flowing within the chamber section 125, enhancing the performance of the heat exchanger 100. The smooth contour of the bottom surface first extension member 210 also aids in reducing the effect of pressure drop to heat exchange medium flow within the chamber section 125, improving the overall performance of the heat exchanger 100. The second extension member 165 has a top surface second extension member 215 facing towards the second angled face 155. The top surface second extension member 215 closely follows the contour of the chamber lateral wall 135, providing maximum agitation and mixing effect to the heat exchange medium flowing within the chamber section 125, enhancing the performance of the heat exchanger 100. The smooth contour of the top surface second extension member 215 also aids in reducing the effect of pressure drop to the heat exchange medium flow, improving the overall performance of the heat exchanger 100.

Now referring to FIGS. 9, 10, 11, and 12, another embodiment of the present invention is shown. A medium directing member 130A is positioned within the chamber section 125, in a vessel established by the chamber lateral wall 135, the chamber anterior wall 140, and the chamber posterior wall 145. A first angled face 150A features a sloped planar surface positioned with a spatial separation from the chamber anterior wall 140. The first angled face 150A is generally longitudinally axially aligned with the disk inlet 105 from which the heat exchange medium may be directed to the first angled face 150A. The first angled face 150A is positioned and provided with ample vertical and lateral planar surface within the chamber section 125, obstructing direct flow of the heat exchange medium from the disk inlet 105 to the disk outlet 110. The medium directing member 130A is provided with a first extension member 160A and a second extension member 165A, extending away from the top leading edge and the bottom leading edge of the medium directing member 130A, respectively. The first extension member 160A extends vertically away from the top leading edge of the medium directing insert 130A. The first extension member 160A features a planar surface facing the chamber posterior wall 145, wherein the surface of the first extension member 160A facing the chamber posterior wall 145 engages the surface of the chamber posterior wall 145. The plane established by the planar surface of the first extension member 160A facing the chamber posterior wall 145 and the planar surface established by the chamber posterior wall 145 are generally parallel to each other. The surface of the first extension member 160A facing the chamber posterior wall 145 may be mechanically coupled to the chamber posterior wall 145, or it may be brazed, welded, or bonded together by adhesive means known in the art. The lateral width of the first extension member 160A may be generally set at the width of the first angled face 150A. However, the first extension member 160A may be wider or narrower than the width of the first angled face 150A. The leading edge of the first extension member 160A may extend vertically to contact the chamber lateral wall 135. In another embodiment of the present invention, the leading edge of the first extension member 160A may extend vertically towards the chamber lateral wall 135, though it may not contact the chamber lateral wall 135. The first extension member 160A and the first angled face 150A may be formed from a unitary piece of material. In another embodiment of the present invention, the first extension member 160A and the first angled face 150A may be fabricated from two separate pieces, coupled together by mechanical means, brazing, welding, bonding by adhesive means, or other coupling means known in the art.

In an embodiment of the present invention, the second extension member 165A extends vertically away from the bottom leading edge of the medium directing member 130A. The second extension member 165A features a planar surface facing the chamber anterior wall 140, wherein the surface of the second extension member 165A facing the chamber anterior wall 140 engages the surface of the chamber anterior wall 140. The plane established by the surface of the second extension member 165A facing the chamber anterior wall 140 and the planar surface established by the chamber anterior wall 140 are generally parallel to each other. The surface of the second extension member 165A facing the chamber anterior wall 140 may be mechanically coupled to the chamber lateral anterior wall 140, or it may be brazed, welded, or bonded together by adhesive means known in the art. The lateral width of the second extension member 165A may be generally set at the width of the first angled face 150A. However, the second extension member 165A may be wider or narrower than the width of the first angled surface 150A. The leading edge of the second extension member 165A may extend vertically to contact the chamber lateral wall 135. In another embodiment of the present invention, the leading edge of the second extension member 165A may extend vertically towards the chamber lateral wall 135, though it may not contact the chamber lateral wall 135. The second extension member 165A and the first angled face 150A may be formed from a unitary piece of material. In another embodiment of the present invention, the second extension member 165A and the first angled face 150A may be fabricated from two separate pieces, coupled together by mechanical means, brazing, welding, bonding by adhesive means, or other coupling means known in the art.

Figure 13:
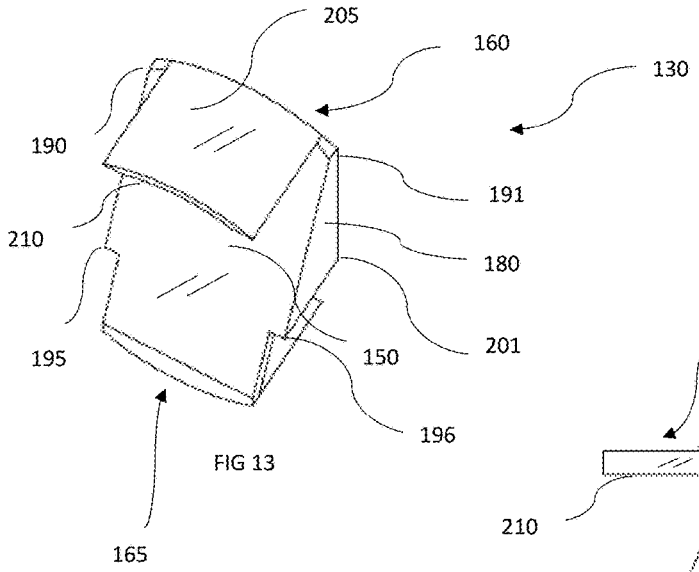
FIG. 13 is a perspective top anterior view of an embodiment of a medium directing member according to an embodiment of the present invention.
Figure 14:
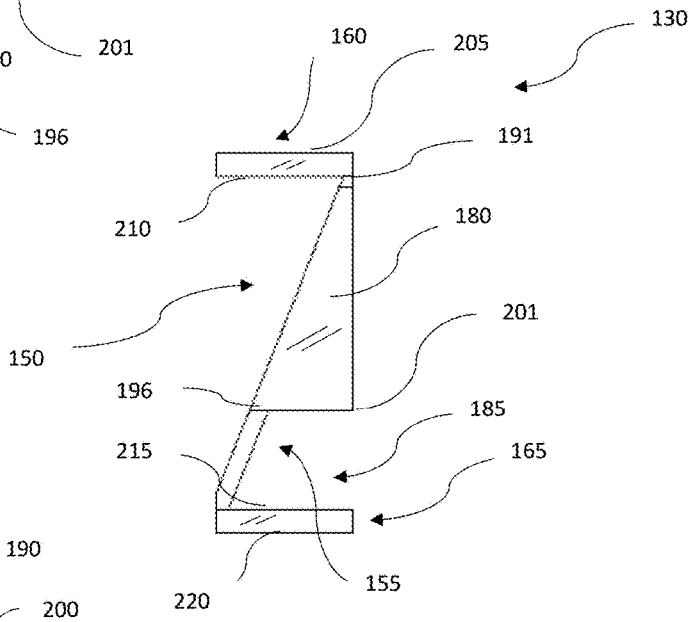
FIG. 14 is a side view of a medium directing member according to an embodiment of the present invention.

Now referring to FIG. 13, FIG. 14, and FIG. 15, an embodiment of the medium directing member 130 is shown. The medium directing member 130 is generally a separate component from the chamber section 125, coupled to the interior of the chamber section 125 to obtain a desired heat exchange medium flow effect within the chamber section 125, improving the heat transfer performance of the heat exchanger 100. The medium directing member 130 features a sloped planar surface with the first angled face 150. The first angled face 150 is generally planar, with the planar surface edges generally free of obstruction at least on its lateral edges. In an embodiment of the present invention, the first angled face 150 may be generally planar, with the planar surface edges generally free of obstruction on its vertical edges as well as its lateral edges.

Referring in particular to FIG. 13 and FIG. 14, the medium directing member 130 is provided with the first extension member 160 and the second extension member 165, extending away from the top leading edge and the bottom leading edge of the medium directing member 130, respectively. The first extension member 160 features an outer surface facing towards the chamber lateral wall 135 conforming to the chamber lateral wall 135 contour, extending out from the top leading edge of the medium directing insert 130 in an anterior direction, positioned at an acute angle in relation to the first angled surface 150. The second extension member 165, on the other hand, extend away in a posterior direction from the bottom leading edge of the medium directing insert 130, positioned at a reflex angle in relation to the first angled face 150. The second extension member 165 also features an outer surface facing towards the chamber lateral wall 135 conforming to the chamber lateral wall 135 contour.

Referring to FIG. 14, the first extension member 160 features the top surface first extension member 205, an outwardly facing surface of the first extension member 160 facing the chamber lateral wall 135. The top surface first extension member 205 is generally formed to engage the surface of the chamber lateral wall 135. The top surface first extension member 205 and the chamber lateral wall 135 may be mechanically coupled to each other, or it may be brazed, welded, or bonded together by adhesive means known in the art. The second extension member 165 features the bottom surface second extension member 220, an outwardly facing surface of the second extension member 165 facing the chamber lateral wall 135. The bottom surface second extension member 220 is generally formed to engage the surface of the chamber lateral wall 135. The bottom surface second extension member 220 and the chamber lateral wall 135 may be mechanically coupled to each other, or it may be brazed, welded, or bonded together by adhesive means known in the art. The lateral width of the first extension member 160 and the second extension member 165 may be generally set at the width of the first angled face 150. However, the first extension member 160 and the second extension member 165 may be wider or narrower than the width of the first angled face 150. The leading edge of the first extension member 160 may extend axially in an anterior direction to contact the chamber anterior wall 140. In another embodiment of the present invention, the leading edge of the first extension member 160 may extend axially towards the chamber anterior wall 140, though it may not contact the chamber anterior wall 140. The leading edge of the second extension member 165 may extend axially in a posterior direction to contact the chamber posterior wall 145. In another embodiment of the present invention, the leading edge of the second extension member 165 may extend axially towards the chamber posterior wall 145, though it may not contact the chamber posterior wall 145. It is desired to have the surface of the first extension member 160 and the second extension member 165 facing the chamber lateral wall 135 to be coupled to the chamber lateral wall 135 to have an effective heat conducting surface between the medium directing member 130 and the chamber section 125. The increased surface contact between the first extension member 160 and the second extension member 165 to the chamber lateral wall 135 generally results in an improvement to heat transfer characteristics of the heat exchanger 100, as the enhanced surface contact between the chamber section 125 and the medium directing member 130 improves heat transfer conduction between the two components, resulting in an efficient flow of heat between the respective components, improving the overall heat transfer performance of the heat exchanger 100.

The first extension member 160 and the first angled face 150 may be formed from a unitary piece of material. In another embodiment of the present invention, the first extension member 160 and the first angled face 150 may be fabricated from two separate pieces, coupled together by mechanical means, brazing, welding, bonding by adhesive means, or other coupling means known in the art. The second extension member 165 and the first angled face 150 may be formed from a unitary piece of material. In another embodiment of the present invention, the second extension member 165 and the first angled face 150 may be fabricated from two separate pieces, coupled together by mechanical means, brazing, welding, bonding by adhesive means, or other coupling means known in the art.

Now referring to FIG. 13 and FIG. 14, the medium directing member 130 features the second angled face 155, generally on the opposing side of the first angled face 150. The second angled face 155 features a planar surface, laterally partially bound by a pair of lateral planar walls, the first lateral wall 170 and the second lateral wall 180, abutting the lateral side of the second angled face 155. The first lateral wall 170, a planar feature, is coupled to the first lateral side of the medium directing member 130, forming the first lateral wall on the second angled face 155. In an embodiment of the present invention, the first lateral wall 170 is generally triangular in shape, having a top vertex 190, an anterior vertex 195, and a posterior vertex 200. The top vertex 190 generally align at the top lateral edge of the second angled face 155, restricting flow of the heat exchange medium from the posterior side of the medium directing member 130 to the anterior side of the medium directing member 130. The anterior vertex 195 is located along the lateral edge of the second angled face 155, positioned between the top edge and the bottom edge of the second angled face 155, leaving a portion of the second angled face 155 laterally exposed. The posterior vertex 200 is generally longitudinally axially aligned to the anterior vertex 195, forming a bottom edge to the first lateral wall 170. The top vertex 190 and the posterior vertex 200 is generally aligned vertically, forming a posterior edge to the first lateral wall 170, coupled to the surface of the chamber posterior wall 145, restricting flow of the heat exchange medium from the posterior side of the medium directing member 130 to the anterior side of the medium directing member 130. The anterior vertex 195 and the posterior vertex 200 form a bottom edge to the first lateral wall 170, forming the first lateral passthrough 175 between the first lateral wall 170 and the chamber lateral wall 135.

In an embodiment of the present invention shown in FIG. 13, FIG. 14, and FIG. 15, the first lateral wall 170 is presented as generally triangular in shape. However, the first lateral wall 170 may be of any geometric shape like a trapezoidal, for example. Similarly, although the bottom edge of the first lateral wall 170 formed between the anterior vertex 195 and the posterior vertex 200 is presented as a generally straight edge, in other embodiment of the present invention, the edge formed between the anterior vertex 195 and the posterior vertex 200 may not be a straight line. In an embodiment of the present invention, the bottom edge formed between the anterior vertex 195 and the posterior vertex 200 is shown to be in a parallel longitudinal axial relationship with the plane established by the chamber lateral wall 135. In other embodiments of the present invention, the bottom edge formed between the anterior vertex 195 and the posterior vertex 200 may not be in a parallel longitudinal axial relationship with the plane established by the chamber lateral wall 135.

Referring now to FIG. 15, the second angled face 155 features the second lateral wall 180, a planar feature, generally coupled to the second lateral side of the medium directing member 130, positioned on the opposing lateral side of the second angled face 155 in relation to the first lateral wall 170. In an embodiment of the present invention, the second lateral wall 180 is generally triangular in shape, having a top vertex 191, an anterior vertex 196, and a posterior vertex 201. The top vertex 191 generally align at the top lateral edge of the second angled face 155, restricting flow of the heat exchange medium from the posterior side of the medium directing member 130 to the anterior side of the medium directing member 130. The anterior vertex 196 is positioned along the lateral edge of the second angled face 155, positioned between the top edge and the bottom edge of the second angled face 155, leaving a portion of the second angled face 155 laterally exposed. The posterior vertex 201 is generally longitudinally axially aligned to the anterior vertex 196, forming a bottom edge to the second lateral wall 180. The top vertex 191 and the posterior vertex 201 is generally vertically aligned, forming a posterior edge to the second lateral wall 180, coupled to the surface of the chamber posterior wall 145, restricting flow of the heat exchange medium from the posterior side of the medium directing member 130 to the anterior side of the medium directing member 130. The anterior vertex 196 and the posterior vertex 201 form a bottom edge to the second lateral wall 180, forming the second lateral passthrough 185 between the second lateral wall 180 and the chamber lateral wall 135.

In an embodiment of the present invention shown in FIG. 15, the second lateral wall 180 is presented as generally triangular in shape. However, the second lateral wall 180 may be of any geometric shape like a trapezoidal, for example. Similarly, although the bottom edge of the second lateral wall 180 formed between the anterior vertex 196 and posterior vertex 201 is shown as a generally straight edge, in other embodiment of the present invention, the edge formed between the anterior vertex 196 and the posterior vertex 201 may not be a straight line. In an embodiment of the present invention, the bottom edge formed between the anterior vertex 196 and the posterior vertex 201 is shown to be in a parallel longitudinal axial relationship with the plane established by the chamber lateral wall 135. In other embodiments of the present invention, the bottom edge formed between the anterior vertex 196 and the posterior vertex 201 may not be in a parallel longitudinal axial relationship with the plane established by the chamber lateral wall 135.

In an embodiment of the present invention, the first lateral wall 170 and the second lateral wall 180 are shown as generally similar in shape. However, in other embodiment of the present invention, the shape of the first lateral wall 170 and the second lateral wall 180 may differ in shape or configuration from each other. The first lateral wall 170 and the second lateral wall 180 is shown as having a generally planar surface with no orifices. However, in other embodiment of the present invention, the surface of the first lateral wall 170 and the second lateral wall 180 may not be planar. Similarly, the first lateral wall 170 and the second lateral wall 180 may feature one or a plurality of orifices. In another embodiment of the present invention, the first lateral wall 170 and the second lateral wall 180 may feature one protrusion or a plurality of protrusions, facing inwardly or outwardly from the respective surface of the first lateral wall 170 and the second lateral wall 180.

The first lateral wall 170 may be formed from a unitary piece of material as a component of the medium directing member 130. In an embodiment of the present invention, the first lateral wall 170 may be formed into shape by folding the lateral material comprising the second angled face 155. In yet another embodiment of the present invention, the first lateral wall 170 may be a separate component, coupled to the medium directing member 130 by means of welding, brazing, mechanical coupling, or adhesive means, for example. Similarly, the second lateral wall 180 may be formed from a unitary piece of material as a component of the medium directing insert 130. In an embodiment of the present invention, the second lateral wall 180 may be formed into shape by folding the lateral material comprising the first angled face 155. In another embodiment of the present invention, the second lateral wall 180 may be a separate component, coupled to the medium directing member 130 by means of welding, brazing, mechanical coupling, or adhesive means, for example.

Figure 16:
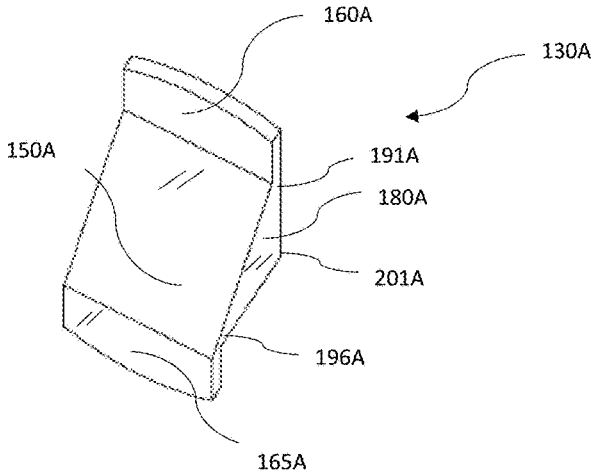
FIG. 16 is a perspective top anterior view of a medium directing member according to another embodiment of the present invention.
Figure 17:
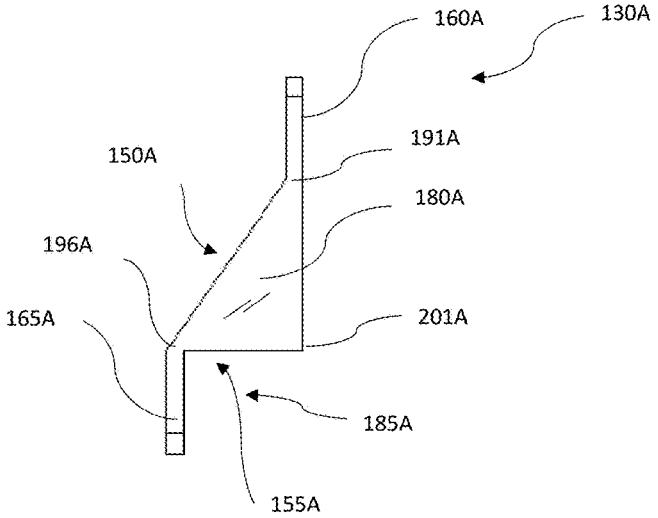
FIG. 17 is a side view of a medium directing member according to another embodiment of the present invention.
Figure 18:
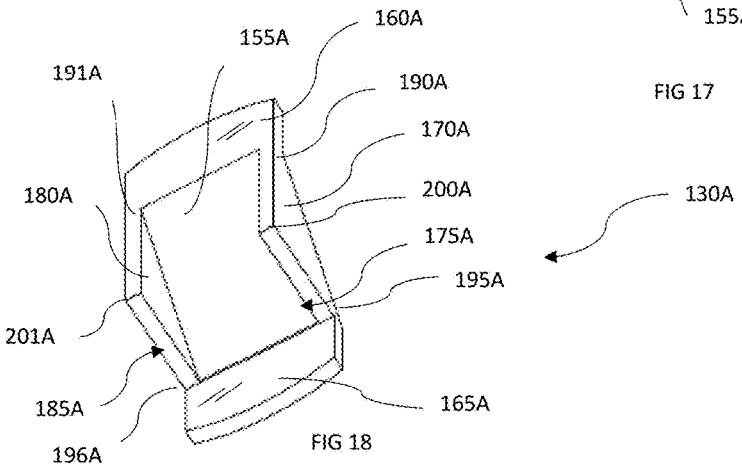
FIG. 18 is a perspective bottom posterior view of a medium directing member according to another embodiment of the present invention.

Now referring to FIG. 16, FIG. 17 and FIG. 18, another embodiment of the medium directing member 130A is shown. The medium directing member 130A features a second angled face 155A, generally on the opposing side of the first angled face 150A. The second angled face 155A features a planar surface, laterally bound by a first lateral wall 170A and a second lateral wall 180A. The first lateral wall 170A and the second lateral wall 180A are generally planar in feature. The first lateral wall 170A is coupled to a first lateral side of the medium directing member 130A, forming the first lateral wall on the second angled face 155A. In an embodiment of the present invention, the first lateral wall 170A is generally triangular in shape, having a top vertex 190A, an anterior vertex 195A, and a posterior vertex 200A. The top vertex 190A generally align at the top lateral edge of the second angled face 155A, restricting flow of the heat exchange medium from the posterior side of the medium directing member 130A to the anterior side of the medium directing member 130A. The anterior vertex 195A is generally aligned at the bottom lateral edge of the second angled face 155A, restricting flow of the heat exchange medium from the posterior side of the medium directing member 130A to the anterior side of the medium directing member 130A. The posterior vertex 200A is generally longitudinally axially aligned to the anterior vertex 195A, forming a bottom edge to the first lateral wall 170A. The top vertex 190A and the posterior vertex 200A are generally vertically aligned, forming a posterior edge to the first lateral wall 170A, coupled to the surface of the chamber posterior wall 140, restricting flow of the heat exchange medium from the posterior side of the medium directing member 130A to the anterior side of the medium directing member 130A. The anterior vertex 195A and the posterior vertex 200A form a bottom edge to the first lateral wall 170A, forming a first lateral passthrough 175A between the first lateral wall 170A and the chamber lateral wall 135.

In an embodiment of the present invention shown in FIG. 17 and FIG. 18, the first lateral wall 170A is presented as generally triangular in shape. However, the first lateral wall 170A may be of any geometric shape like a trapezoidal, for example. Similarly, although the bottom edge of the first lateral wall 170A formed between the anterior vertex 195A and posterior vertex 200A is shown as a generally straight edge, in other embodiment of the present invention, the edge formed between the anterior vertex 195A and the posterior vertex 200A may not be a straight line or, in a parallel longitudinal axial relationship with the plane established by the chamber lateral wall 135.

Referring now to FIG. 16 and FIG. 17, the second angled face 155A features the second lateral wall 180A, generally positioned on the opposing lateral side in relation to the first lateral wall 170A, on a second lateral side of the second angled face 155A. In an embodiment of the present invention, the second lateral wall 180A is generally triangular in shape, having a top vertex 191A, an anterior vertex 196A, and a posterior vertex 201A. The top vertex 191A generally align at the top lateral edge of the second angled face 155A, restricting flow of the heat exchange medium from the posterior side of the medium directing member 130A to the anterior side of the medium directing member 130A. The anterior vertex 196A is generally aligned at the bottom lateral edge of the second angled face 155A, restricting flow of the heat exchange medium from the posterior side of the medium directing member 130A to the anterior side of the medium directing member 130A. The posterior vertex 201A is generally longitudinally axially aligned to the anterior vertex 196A, forming a bottom edge to the second lateral wall 180A. The top vertex 191A and the posterior vertex 201A are generally vertically aligned, forming a posterior edge to the second lateral wall 180A, coupled to the surface of the chamber posterior wall 145, restricting flow of the heat exchange medium from the posterior side of the medium directing member 130A to the anterior side of the medium directing member 130A. The anterior vertex 196A and the posterior vertex 201A form a bottom edge to the second lateral wall 180A, forming a second lateral passthrough 185A between the second lateral wall 170A and the chamber lateral wall 135.

In an embodiment of the present invention, the chamber section 125, the inlet tube 115, and the outlet tube 120 may be formed from multiple components utilizing stamping processes, or may be formed from a single planar material utilizing stamping, by casting, machining, cold forging, roll forming, hydroforming, 3-D printing, or a combination of various fabricating means known in the art. Similarly, the medium directing member 130 may be formed from multiple components utilizing stamping processes, or may be formed from a single planar material utilizing stamping, by casting, machining, cold forging, roll forming, hydroforming, 3-D printing, or a combination of various fabricating means known in the art.

In an embodiment of the present invention, the first angled face 150 and the second angled face 155 are presented as generally planar surfaces. In other embodiment of the present invention, the first angled face 150 and the second angled face 155 may feature a convex or a concave surface features, or a combination of more than one such surface features.

In an embodiment of the present invention, the planar feature established by the surface of the first angled face 150 and the second angled face 155 are generally shown as parallel to each other. In other embodiment of the present invention, the planar feature established by the surface of the first angled face 150 and the second angled face 155 may not be in a parallel relationship to each other.

In yet another embodiment of the present invention, the flow direction described herein may be reversed. In such an embodiment, the disk outlet 110 may function as an inlet to introduce heat exchange medium into the heat exchanger 100, and the disk inlet 105 may functions as an outlet to discharge heat exchange medium out of the heat exchanger 100. In such an embodiment, the flow of heat exchange medium within the chamber section 125 may be similarly reversed, wherein heat exchange medium introduced from the disk outlet 110 first encounters the second angled face 155, flows through the chamber section 125 in a reverse manner, then encounters the first angled face 150 before being discharged out of the heat exchanger 100 out of the disk inlet 105.

The heat exchanger 100 may be utilized as a cooler, a condenser, an evaporator, a radiator, or any other application requiring heat to be transferred from one heat exchange medium to another heat exchange medium. Heat exchange medium may be air, liquid, or gas, known in the art. In an embodiment of the present invention, more than one type of heat exchange medium may be utilized. Furthermore, in some embodiments of the present invention, heat exchange medium may by combined with more than one type of material, such as with air and silica gel solids to obtain additional desired features, for example.

The heat exchanger 100 may comprise of ferrous, non-ferrous, plastics, or other materials such as composites, for example. The heat exchanger 100 may also comprise of a combination of more than one type of material suitable for heat exchange application known in the art.

Many modifications and variations of the present invention are possible in light of the above teachings. Therefore, within the scope of the appended claims, the present invention may be practiced other than as specifically described.

What is claimed is:

1. A heat exchanger having an inlet tube, an outlet tube, and a chamber section, the chamber section comprising:

a chamber anterior wall and a chamber posterior wall;

a chamber lateral wall; and a medium directing member disposed within, wherein the chamber section is formed by the chamber anterior wall and the chamber posterior wall being longitudinally spaced apart, and joined concentrically together by the chamber lateral wall, the medium directing member has a pair of planar surfaces, comprising of a first angled face and a second angled face, the second angled face generally positioned on the opposing side of the first angled face, wherein the first angled face is generally facing towards the chamber anterior wall and the second angled face is generally facing towards the chamber posterior wall, the medium directing member has a first extension member on a first vertical leading edge, having a surface feature axially divergent from the plane established by the first angled face, the first extension member having an outside surface facing a chamber section interior wall and conforming to the shape of the chamber section interior wall, wherein at least part of the outside surface of the first extension member is engagingly coupled to the chamber section, the medium direction member has a second extension member on a second vertical leading edge, having a surface feature axially divergent from the plane established by the first angled face, located generally on the opposite end from the first extension member, the second extension member having an outside surface facing the chamber section interior wall and conforming to the shape of the chamber section interior wall, wherein at least part of the outside surface of the second extension member is engagingly coupled to the chamber section, the first angled face of the medium directing member is set at an angle with respect to a longitudinal axis of the inlet tube, the first angled face is set at a longitudinal axial distance from the inlet tube, while positioned longitudinally with respect to the inlet tube axis, provided with ample lateral and vertical surface area to obstruct direct flow of heat exchange medium from the inlet tube to the outlet tube, while vertical edges and lateral edges of the first angled face are clear of obstruction to the chamber section interior, a plane established by the first extension member and the second extension member are generally parallel to each other, the plane established by the first angled face and the second angled face are generally parallel to each other, the second angle face is at least partially coupled on a first lateral side by a first lateral wall, the first lateral wall having a bottom edge formed between an anterior vertex and a posterior vertex of the first lateral wall, the bottom edge of the first lateral wall set apart from the chamber lateral wall, forming a first lateral passthrough therebetween, the second angled face is at least partially coupled on a second lateral side by a second lateral wall, generally on the opposite lateral side from the first lateral wall, the second lateral wall having a bottom edge formed between an anterior vertex and a posterior vertex of the second lateral wail, the bottom edge of the second lateral wall set apart from the chamber lateral wall, forming a second lateral passthrough therebetween, and the first lateral passthrough and the second lateral passthrough are spaced apart, while being laterally aligned to each other.

2. The heat exchanger of claim 1, wherein the first extension member is set at an acute angle in relation to the first angled face, extending towards the chamber anterior wall, and the second extension member is set at a reflex angle in relation to the first angled face, extending towards the chamber posterior wall.

3. The heat exchanger of claim 2, wherein the first extension member is bonded to the chamber lateral wall.

4. The heat exchanger of claim 2, wherein the second extension member is bonded to the chamber lateral wall.

5. The heat exchanger of claim 2, wherein a plurality of heat exchangers are coupled together in a serial manner to form a larger heat exchanger assembly.

6. The heat exchanger of claim 2, wherein a plurality of heat exchangers are coupled together in a parallel fashion to form a larger heat exchanger assembly.

7. The heat exchanger of claim 1, wherein the first extension member extends vertically towards the chamber lateral wall, having one side of the first extension member engagingly coupled the chamber posterior wall, and the second extension member extending vertically towards the chamber lateral wall, having one side of the second extension member engagingly coupled to the chamber anterior wall.

8. The heat exchanger of claim 7, wherein the first extension member is bonded to the chamber posterior wall.

9. The heat exchanger of claim 7, wherein the second extension member is bonded to the chamber anterior wall.

10. The heat exchanger of claim 7, wherein a plurality of heat exchangers are coupled together in a serial manner to form a larger heat exchanger assembly.

11. The heat exchanger of claim 7, wherein a plurality of heal exchangers are coupled together in a parallel fashion to form a larger heat exchanger assembly.

* * * * *